United States Patent [19]

Winter

[11] 3,935,827

[45] Feb. 3, 1976

[54] THREAD CUTTER MECHANISM FOR SEWING MACHINES

[75] Inventor: Frank F. Winter, Chicago, Ill.

[73] Assignee: Union Special Corporation, Chicago, Ill.

[22] Filed: July 22, 1974

[21] Appl. No.: 490,783

[52] U.S. Cl. ..... 112/252

[51] Int. Cl.[2] ..... D05B 65/00

[58] Field of Search ..... 112/65, 66, 70, 130, 187, 112/252

[56] References Cited

UNITED STATES PATENTS

| | | | |
|---|---|---|---|
| 2,070,029 | 2/1937 | Spaine | 112/252 |
| 2,335,827 | 11/1943 | Gunther | 112/252 |
| 2,474,710 | 6/1949 | Wood | 112/252 |
| 2,968,269 | 1/1961 | Smith et al. | 112/252 |
| 3,386,402 | 6/1968 | Ross | 112/252 |
| 3,443,540 | 5/1969 | Hannemann et al. | 112/252 |
| 3,602,170 | 8/1971 | Sakashita | 112/252 |
| 3,605,664 | 9/1971 | Hedegaard | 112/252 |
| 3,709,176 | 1/1973 | Papajewski | 112/252 |
| 3,776,161 | 12/1973 | Papajewski et al. | 112/252 |

*Primary Examiner*—Alfred R. Guest

*Attorney, Agent, or Firm*—Diller, Brown, Ramik & Wight

[57] ABSTRACT

This disclosure relates to a thread cutter mechanism for sewing machines wherein at the end of a stitching operation, a spreader member extends into the needle thread loop and expands the same transversely so that both the bobbin thread and the needle thread may be severed in a single operation. Cooperating cutter knives, mounted to swing arcuately, cooperate with the loop spreader to effect the necessary thread cutting. In addition, there is provided a bobbin thread pull-off member which serves to pull thread off of the bobbin prior to the severing of the bobbin thread by the cutter knives. The cutter knives, loop spreader and bobbin thread pull-off member are all actuated in an arcuate path by means of slide bars which are actuated by mechanism controlled in timed relation to the operation of the sewing machine.

15 Claims, 27 Drawing Figures

THREAD CUTTER MECHANISM FOR SEWING MACHINES

This invention relates in general to new and useful improvements in thread cutter mechanisms, and more particularly to a novel thread cutter mechanism for use on a sewing machine known in the sewing trade as a lockstitch bar-tacker. This type of machine is generally disclosed in U.S. Pat. No. 2,822,771 granted to Hale, et al. on Feb. 11, 1958; U.S. Pat. No. 2,906,222 to Ketterer, et al. granted Sept. 29, 1959; U.S. Pat. No. 2,938,477 granted to Graham, et al. on May 31, 1960; and U.S. Pat. No. 3,565,023 of Lukins, granted Feb. 23, 1971.

The thread cutting mechanism of this invention includes pivotally mounted upper and lower cutter knives, a bobbin thread pull-off member, a needle thread loop spreader and a stationary needle thread clamping member. The cutting mechanism is located between a rotary hook and a throat plate of the sewing machine with the knife blades being disposed directly below the throat plate so that after the threads are cut, the thread ends hanging down on the underside of the workpiece will be as short as possible.

It is to be understood that in the normal operation of the sewing machine, a needle thread loop is formed below the throat plate and in each stitching cycle, the loop is drawn up into the fabric being stitched in conjunction with the bobbin thread. In accordance with this invention, just prior to the end of a stitching cycle, a loop spreader, which is operated by a large horizontal rotary cam of the sewing machine, enters into the loop and both spreads the loop and accurately positions the needle thread. At the same time, the usual needle thread clamping device of the sewing machine is disengaged allowing the loop spreader to enter the needle thread loop without breaking the thread.

After the sewing machine stops, mechanism associated with the sewing machine operates the usual work clamp lifter lever which, in turn, actuates the thread cutting knives to sever both the bobbin thread and one leg of the needle thread loop. Just prior to the cutting of the threads, a sufficient amount of bobbin thread to start the next sewing cycle is pulled from the bobbin by the bobbin thread pull-off member.

After the severing of the needle thread and bobbin threads, the thread ends are positioned to insure the proper formation of a stitch at the beginning of the next sewing cycle. To this end, in addition to a sufficient amount of bobbin thread being pulled off, the loop spreader is operatively associated with the needle so that it will draw the depending needle thread into cooperation with a needle thread clamping member so as to lightly clamp the needle thread tail hanging from the needle. Continued operation of the sewing machine will result in the formation of the necessary initial loop to assure the proper formation of a stitch.

A particular feature of the invention is the mounting of the cutter knives to operate with a scissor-type action to positively cut the needle thread and the bobbin thread with the cutter knives moving in arcuate paths.

With the above and other objects in view that will hereinafter appear, the nature of the invention will be more clearly understood by reference to the following detailed description, by the appended claims and the several views illustrated in the accompanying drawings:

Figure 9:
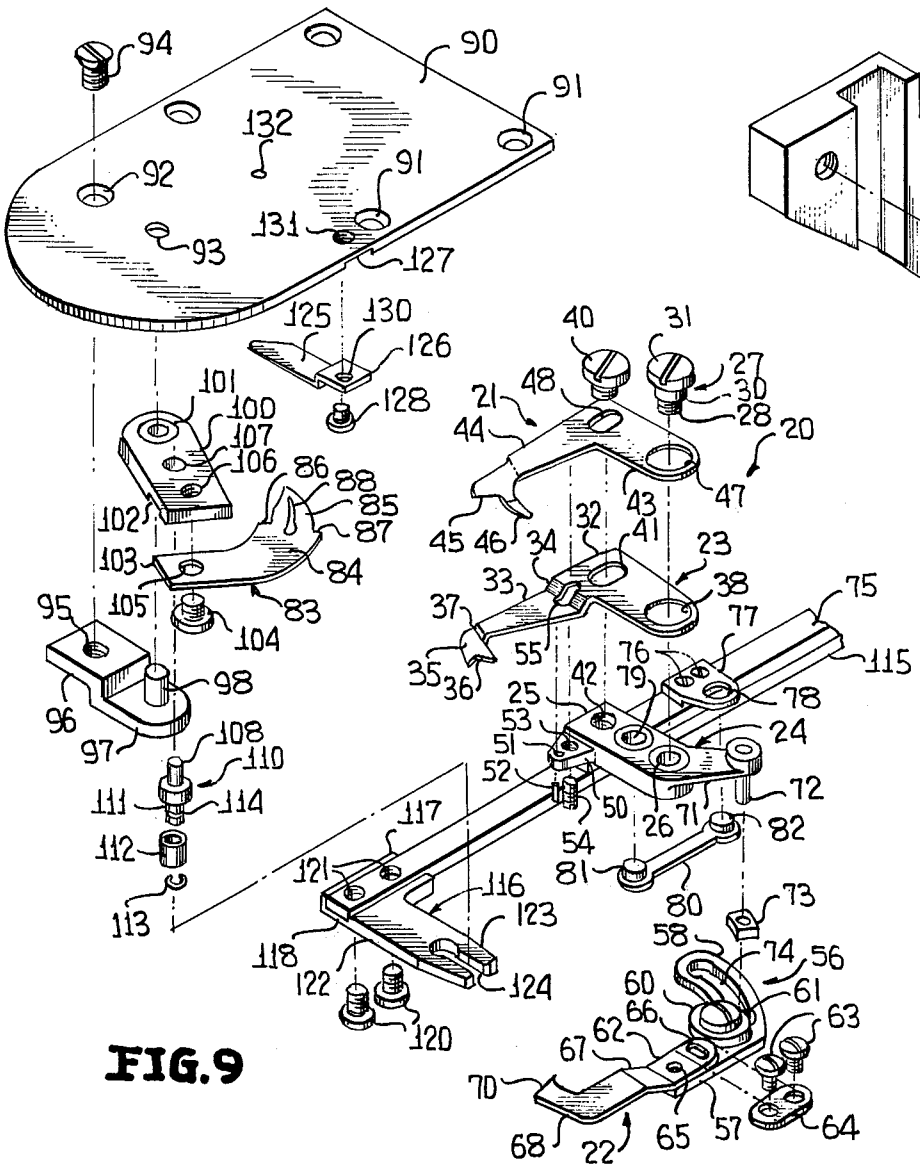
FIG. 9 is an enlarged exploded perspective view of the thread cutter mechanism.

Referring now to the drawings in details, reference is first made to FIG. 9 wherein the various components of the thread cutter mechanism, which is the subject of this invention and which is generally identified by the numeral 20, are shown. First of all, it is to be noted that the thread cutter mechanism includes a lower cutter knife, generally identified by the numeral 21, and an upper cutter knife, generally identified by the numeral 22. Associated with the lower cutter knife 21 is a bobbin thread pull-off member, generally identified by the numeral 23.

The thread cutter mechanism 20 includes a drive lever, which is generally identified by the numeral 24 and generally functions as a support for both the lower cutter knife 21 and the bobbin thread pull-off member 23.

The driving lever 24 includes a body portion 25 which is provided adjacent one end thereof with a bore having a bushing 26 therein which receives a shoulder bolt 27, the shoulder bolt being intended to be fixedly mounted with respect to a sewing machine arm in a manner to be described hereinafter by means of lower threads 28. A shank portion 30 of the shoulder bolt 27 is received within the bushing 26. The shoulder bolt 27 also includes a head 31 which projects above the body 25.

The bobbin thread pull-off member 23 includes a first leg 32 and a second leg 33 which extends substantially at right angles thereto. The leg 33 is joined to the leg 32 by means of a downwardly offset portion 34. At the terminal end of the leg 33 is a curved portion 35 which terminates in a forked end 36. The terminal leg 35 is generally arcuate in outline and is connected to the leg 33 by means of a downwardly offset portion 37.

The leg 32 of the bobbin thread pull-off member 23 is seated on the body 25 with an enlarged bore 38 formed in one end of the leg 32 and being received over the screw head 31. A screw 40 extends through a slotted opening 41 in the leg 32 remote from the opening 38 and is threaded into an internally threaded bore 42 in the body 25.

The lower cutter knife 21 is also generally L-shaped in outline and includes a first leg 43 and a second leg 44 extending at right angles thereto. The leg 44 terminates remote from the leg 43 in a cutting edge 45. Near the end of the leg 44, adjacent the cutting edge 45 there is a slightly curved finger 46 which has the upper surface thereof slightly inclined downwardly towards an end. The finger 46 is generally triangular in outline.

The lower cutter knife 21 is mounted on the body 25 of the driving lever 24 in a manner similar to the mounting of the bobbin thread pull-off member 23. One end portion of the leg 43 is provided with an enlarged opening 47 which is received over the screw head 31 and forms a pivot for the lower cutter knife. The leg 43 is provided with a slotted opening 48 remote from the opening 47 through which the screw 40 passes. It is to be understood that the leg 43 overlies the leg 32 of the bobbin thread pull-off member 23 in that the single screw 40 clamps both the lower cutter knife 21 and the bobbin thread pull-off member 23 in adjusted positions relative to the driving lever 24.

It will be readily apparent that by loosening the screw 40, the bobbin thread pull-off member 23 and the lower cutter knife 21 may be individually arcuately adjusted with respect to the axis of the screw 27. Further, individual vertical adjustment of the cutting edge 45 of the lower cutter knife 21 and the forked end 36 of the bobbin thread pull-off member 23 may be accomplished. To this end the body 25 is provided with an offset ear 50 which has an outer threaded bore 51 through which a set screw 52 may extend with the set screw 52 being adjustable to engage the underside of the leg 33 at varying pressures so as to effect a bending of the leg 33 relative to the leg 32. The ear 50 is provided with a second and inner threaded bore 53 through which a second set screw 54 may pass. The offset portion 34 of the member 23 is provided with a slotted opening 55 which extends longitudinally of the leg 33. The set screw 54 may be passed through the slotted opening 55 so as to engage the underside of the leg 44 and apply a bending pressure thereto to accomplish the vertical adjustment of the knife edge 45.

In order to mount the upper knife 22 for swinging movement, there is provided an upper knife driving lever 56 which is generally L-shaped in outline and includes legs 57 and 58. Generally at the inner section of the legs 57, 58 the lever 56 is provided with a bushing 60 through which a shoulder screw 61 passes with the shoulder screw 61 being engageable in fixed relation with respect to an arm of a sewing machine in a manner to be described hereinafter.

The upper cutter knife 22 includes an end portion 62 which is seated on the leg 57 and is secured thereto by a pair of screws 63. The screws 63 pass through an apertured clamp plate 64 with one of the screws 63 passing through a circular opening 65 in the end portion 62 and the other of the screws 63 passing through a slotted opening 66 in the end portion 62. In this manner the upper cutter knife 22 is arcuately adjustable relative to the driving lever 56.

It is to be noted that the upper cutter knife 22 includes an upwardly extending intermediate portion 67 which terminates in a generally L-shaped end portion 68. The L-shaped end portion 68, in turn, terminates in a cutting edge 70.

In order that the cutter knives 21, 22 may be actuated in unison, the driving lever 24 includes an arm 71 projecting from the body 25 with the outer end of the arm 71, which is disposed in angular relation with respect to the body 25, having a depending driving pin 72. The driving pin 72 is received in a slide block 73 which, in turn, is received within an arcuate slot 74 in the leg 58 of the driving lever 56. Thus, when the driving lever 24 is pivoted in a counterclockwise direction, the driving lever 56 is pivoted in a clockwise direction.

In order to effect pivoting the driving lever 24 about the shoulder bolt 27, there is provided a slide bar 75 which is mounted for axial reciprocable movement initially to the left from the position shown in FIG. 9 and then returning to the right to its original position. The slide bar 75 has mounted on the upper surface thereof by means of a pair of screws 76 a bracket 77 which projects to one side of the slide bar 75 and the projecting end portion being provided with an opening 78. The opening 78 is generally longitudinally aligned with a bushing 79 in the central portion of the body 25 of the driving lever 24. The driving lever 24 is connected to the slide bar 75 by way of the bracket 77 through a drive link 80. The drive link 80 is provided at one end thereof with a pin 81 which is received in the bushing 79 and at the opposite end thereof with a pin 82 which is received within the opening 78. It will be readily apparent that when the slide bar 75 is initially moved to the left, the driving lever 24 will be rotated in a counterclockwise direction so as to move the lower cutter knife 21 from its inoperative position towards the operative position cooperating with the upper cutter knife 22.

The thread cutter assembly 20 also includes loop spreader, generally identified by the numeral 83. The loop spreader 83 includes an arcuate body 84 terminating at one end thereof in a rounded pointed portion 85 of a reduced width defining at its inner section with the body 84 a pair of shoulders 86, 87. Formed in both the body 84 and the rounded end portion 85 is an axially elongated arcuate slot 88 which in a manner described hereinafter will receive the needle of the sewing machine in a selected position of the loop spreader 83.

The loop spreader 83 is supported beneath a conventional throat plate 90 of a sewing machine to be described hereinafter. The throat plate 90, in addition to the usual screw receiving openings 91 for facilitating the mounting thereof, includes a screw receiving opening 92 adjacent an arcuate end thereof. Disposed adjacent the opening 92 and generally in alignment with the longitudinal axis of the throat plate 90 is an opening 93.

cutter control lever 173. The control lever 173 is pivotally mounted at its upper end to the block 166. Further to the left on the arm 170 there is pivotally secured by means of a screw 173A a rod 174 which extends upwardly and is pivotally connected at its upper end to a rocker arm 175 by a screw and nut assembly 176. The rocker arm 175 is, in turn, clamped to a clamp lifting rocker shaft 177 which is journalled in suitable bearings (not shown) in the machine arm 140. The rocker shaft 177, through suitable linkage (not shown), is adapted to lift a work clamp 178 automatically at the end of a tacking operation or at the will of an operator.

Figure 6:
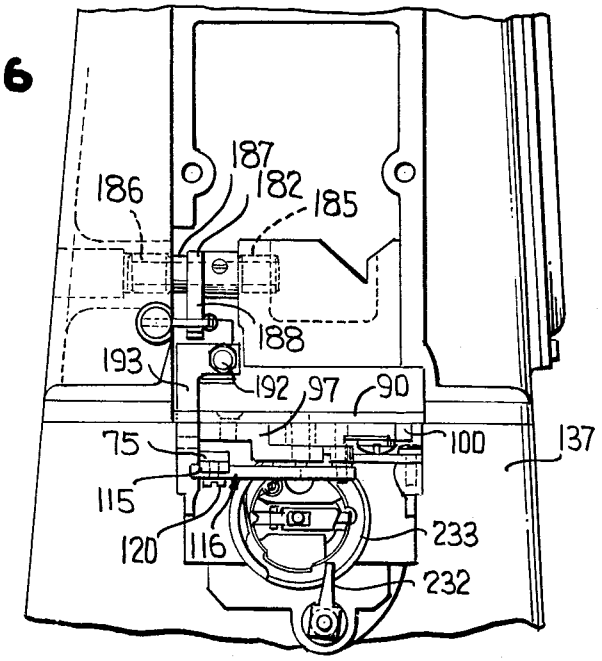
FIG. 6 is a partial end view of the sewing machine as viewed from the left in FIG. 1.

The left end of the arm 170 is shaped to cooperate with a pin 180 carried by one arm 181 of a bellcrank shaped drive lever 182 which is secured to a shaft 183 by means of a set screw 184. The shaft 183 is mounted for oscillatory movement in bearings 185, 186 (FIGS. 4, 6) in the sewing machine frame. The drive lever 182 is held against any axial movement by a spacer 187. The drive lever 182 has a second arm 188 extending downwardly and ending in a flat plate 190. The drive lever is biased in a clockwise direction by a spring 191 and a drive screw 192 carried by a bracket 193 contacts the flat plate 190 and prevents the drive lever from turning in a clockwise direction. The bracket 193 is attached to a short protruding portion 194 of the spreader actuating slide bar 115. The slide bar 115 is mounted for sliding movement in slots 195 cut into certain portions of the machine frame.

The slide bar 75 is also mounted for sliding movement in the same slots and, as previously described, is disposed directly above the slide 115. The cutter actuating slide bar 75 is operated through a bracket 196 fixedly secured to the slide bar 75 and to which is pivotally mounted a slide block 197 which is embraced by a bifurcated end 198 of the cutter control lever 173.

Figure 4:
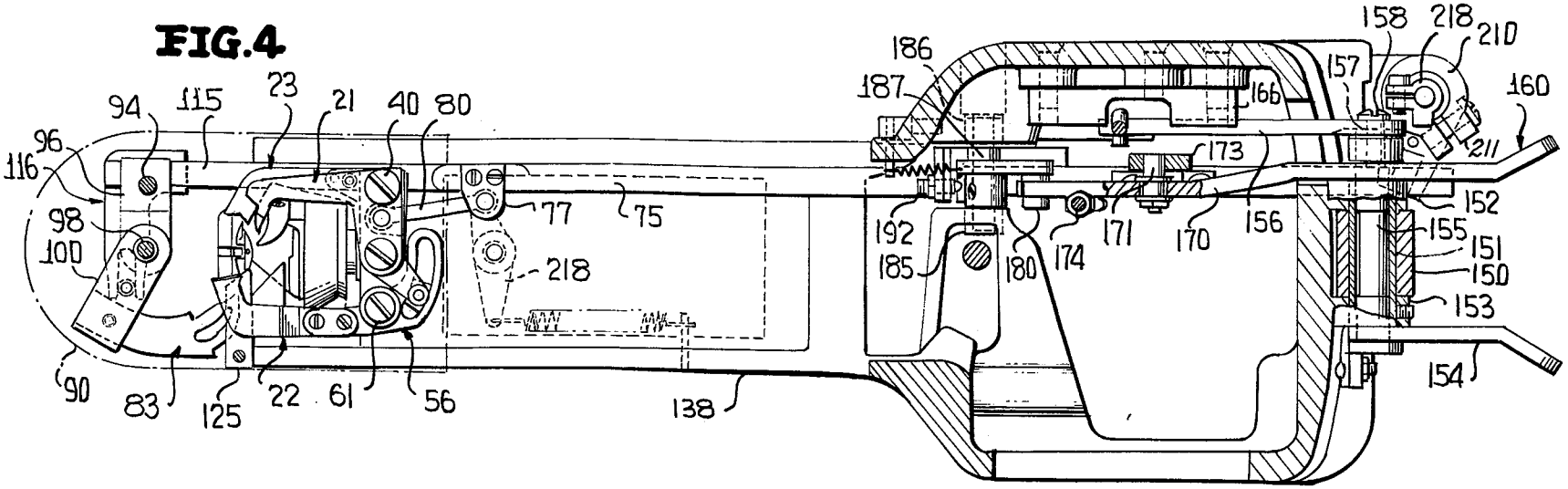
FIG. 4 is a plan view of the sewing machine with parts broken away and shown in section and shows further the details of the thread cutter mechanism and the means for operating the same, the operating means being in their inoperative position.

The spreader actuating slide bar 115 is operated from a cam groove 200 (FIG. 7) formed in the bottom surface of a pattern cam disc 201 mounted in the base 136. The pattern cam disc 201 is driven from the main shaft 144 in a conventional manner by a series of gears, generally identified by the numeral 202 (FIG. 1) and at a slower rate depending on the number of tacking stitches desired for each stitching cycle. The cam groove 200 is tracked by a roller follower 203 carried on a lever 204 pivotally mounted to the base 136 by means of a pivot 205. A link 206 pivotally interconnects the lever 204 with the free end of a rocker arm 207 which is fixedly secured on the lower end of a tubular rock shaft 208. A collar 210 (FIG. 2) having a clamp unit 211 clamping the same to the upper end of the rock shaft 208, which is tubular, has a lug 212 (FIG. 13) which cooperates with a pin 214 carried by a bifurcated arm 215 mounted below the collar 211 on the rock shaft 208. The arm 215 is mounted for rotational movement relative to the rock shaft 208 and has a bifurcated end 216 embracing a slide block 217 which is pivotally secured to the spreader actuating slide bar 115. The slide bar 115 is biased towards the left, as seen in FIG. 4, by a spring loaded lever 218 which has an end 220 (FIG. 12) acting against the head of a screw 221 which secures an adjustable stop block 222 to the underside of the slide bar 115. The stop block 222 cooperates with a cut out 223 in the arm 138 to stop the slide bar 115 after it has returned the loop spreader 83 to its inoperative position.

Figure 1:
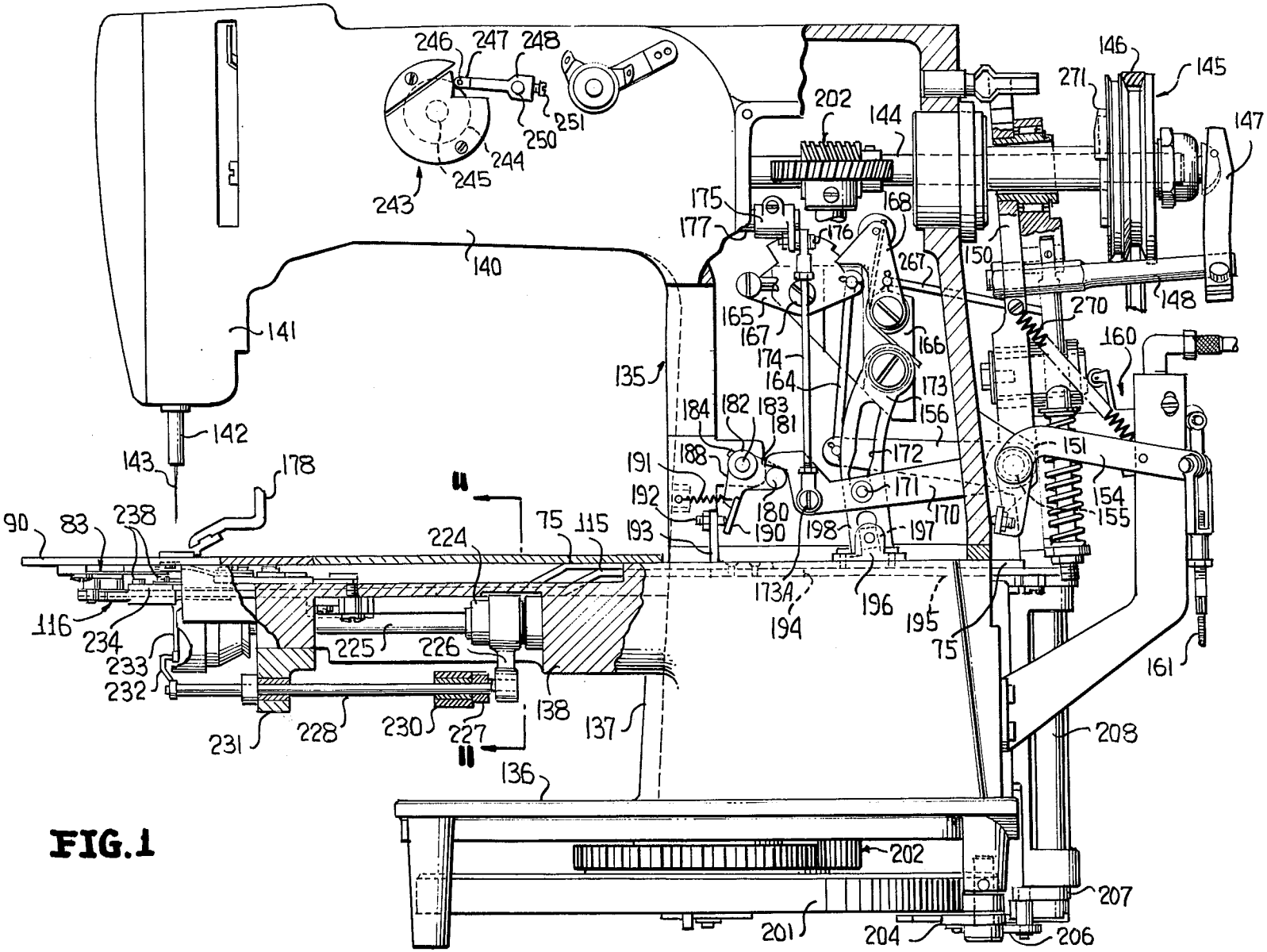
FIG. 1 is an elevational view of a sewing machine incorporating the invention with parts thereof broken away and shown in section so as to clearly illustrate the relationship of the thread cutter mechanism and the means for operating the same.
Figure 10:
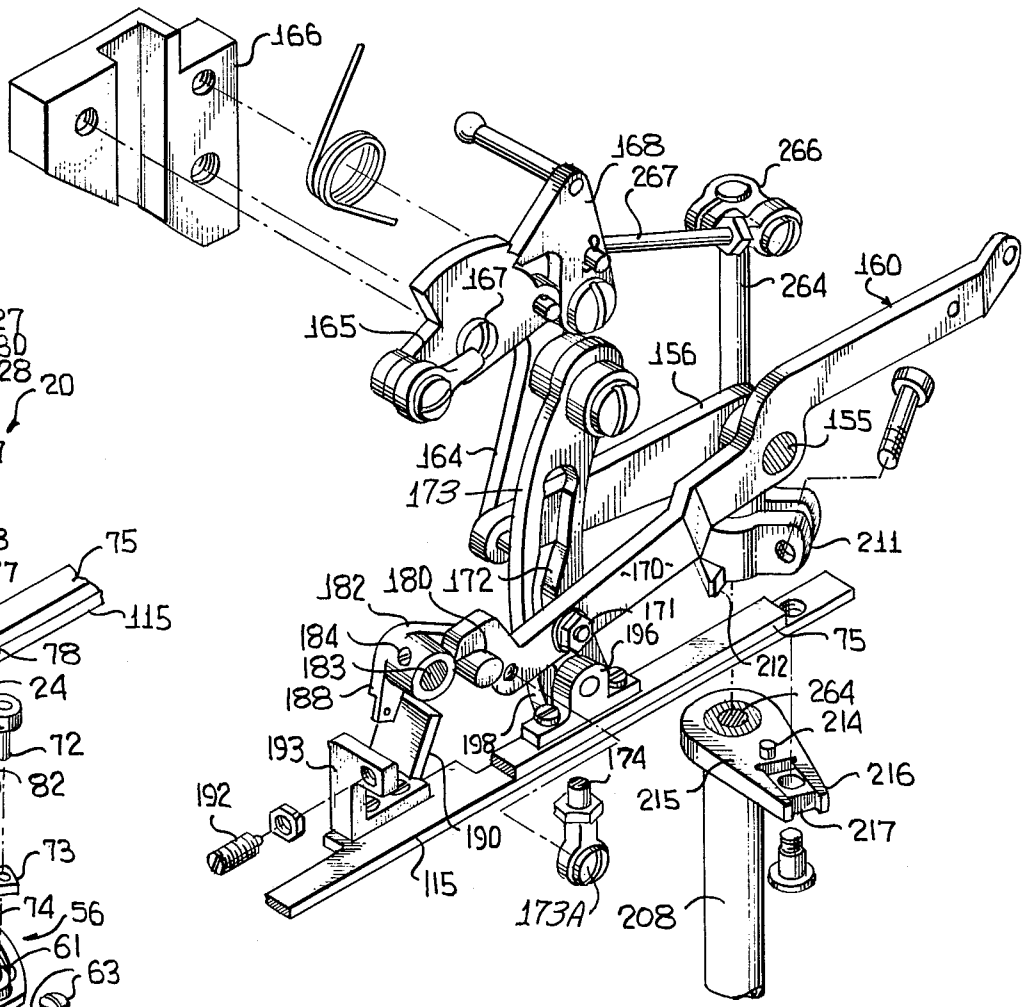
FIG. 10 is an enlarged partially exploded view of the operating means for the thread cutter mechanism.

The illustrated type of sewing machine employs a large rotary hook and bobbin in a standard lockstitch machine. Therefore, a hook opener mechanism is provided to ease the release of the thread loop as it passes from around the bobbin up to the workpiece. As is seen in FIGS. 1 and 10, an eccentric 224 is secured to the rotary hook shaft 225 which is driven by a conventional gears (not shown) from the main shaft 144. A connecting rod 226 is carried by the eccentric 224 at one end and the other end of the connecting rod 226 is pivotally connected to a link 227 clamped to a hook opener shaft 228. The shaft 228 is journalled in the bearings 230, 231 and carries a hook opener finger 232 at the end thereof remote from the connecting rod 226. The finger 232 contacts the bobbin cage basket 233 and with every revolution of the hook shaft 225 the finger 232 rotates the basket 233 slightly to provide an easy release for a needle thread loop.

Figures 7, 8, 11, 12, 13, 14, 15:
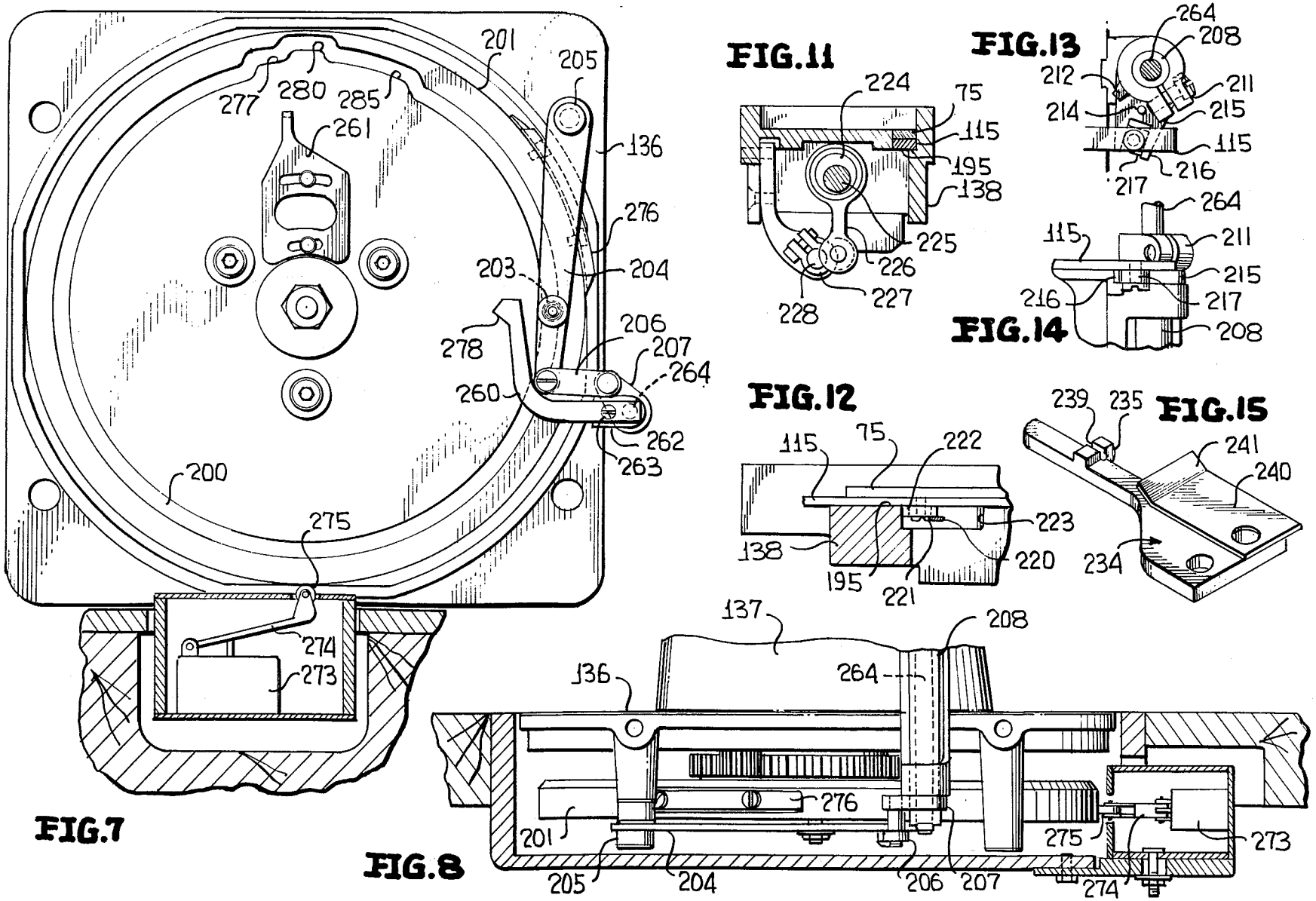
FIG. 7 is a fragmentary bottom plan view of the sewing machine showing the patterned cam discs and the loop spreader and stop motion operating levers which cooperate therewith.
FIG. 8 is a framentary sectional view on an enlarged scale showing the base portion of the sewing machine and the switch for operating a slow speed motor thereof.
FIG. 11 is a fragmentary transverse sectional view taken along the line 11—11 of FIG. 1 and shows the details of a hook opener actuating means.
FIG. 12 is a fragmentary sectional view of the left hand portion of the work supporting arm of FIG. 1 and shows a stop means for the loop spreader.
FIG. 13 is a fragmentary plan view of a portion of the loop spreader operating means.
FIG. 14 is a partial elevational view of the loop spreader operating means of FIG. 13.
FIG. 15 is an enlarged perspective view of a bobbin case positioning finger having a bobbin thread slot and a bobbin thread positioning plate.
Figures 16, 16A, 17, 17A, 18, 18A, 19, 19A, 20, 20A, 21, 21A:
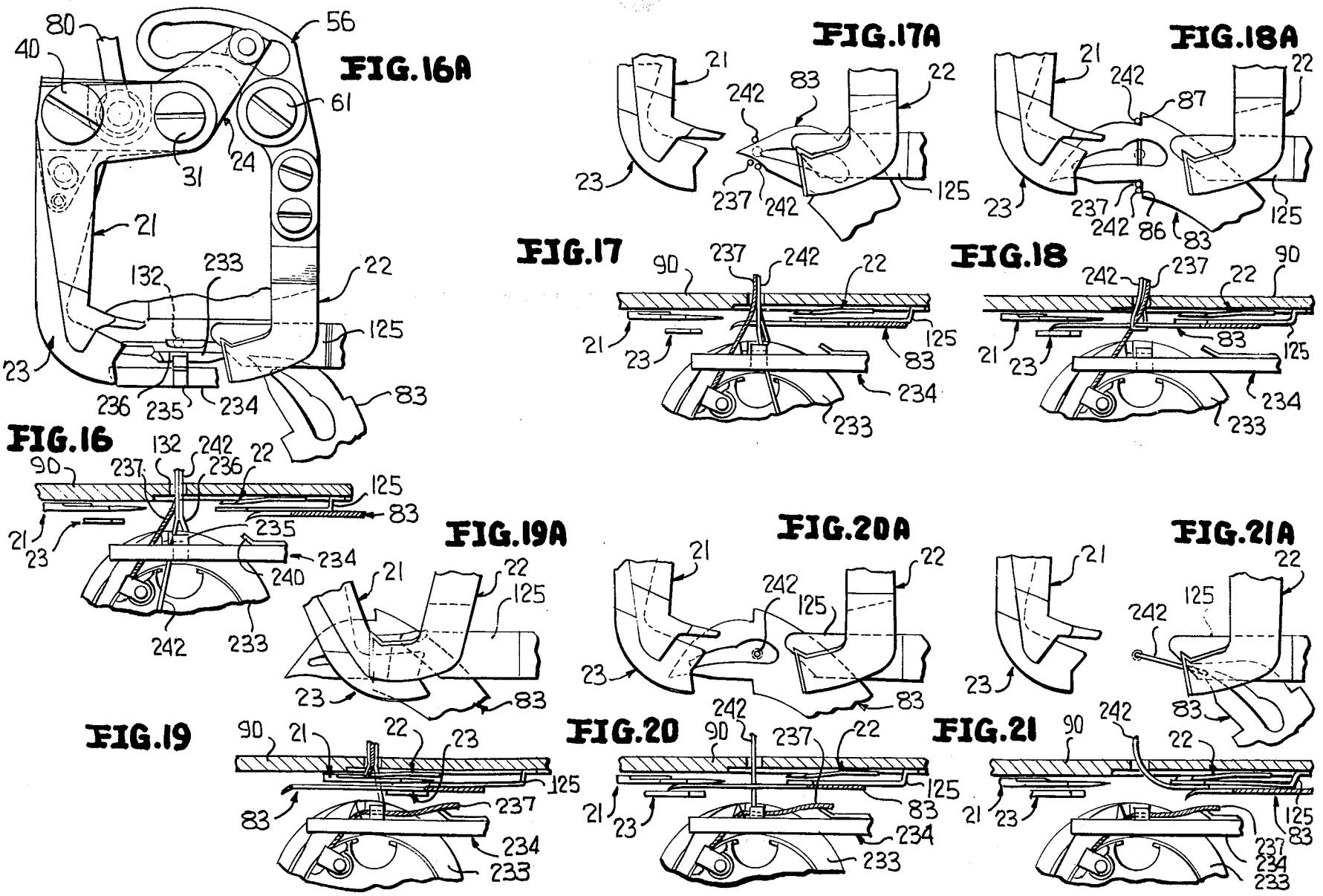
FIGS. 16, 16A – 21,21A are front and top views, respectively, of the thread cutter mechanism in various positions of the thread cutting cycle.

Referring now particularly to FIGS. 15 and 16, there is illustrated a hook retainer 234 which is a standard item. The hook retainer 234 includes a finger 235 which enters a notch 236 in the basket 233 to prevent it from rotating as the needle thread pick-up hook rotates. The finger 235 is provided with a slot 239 into which the bobbin thread 237 is positioned just prior to being cut by the cutter knives 21, 22.

The hook retainer 234 is secured to a portion of the arm 138 by screws 238 (FIG. 1) which pass through suitable openings in the hook retainer 234. One of the screws 238 also secures to the arm 138 a plate 240, which overlies the hook retainer 234. The plate 240 has an upturned end 241 and the end of the cut bobbin thread 237 lays over the end 241 so that it is positioned correctly to be pulled up by a newly formed thread loop 242 as it passes around the basket 233 at the beginning of a tacking operation.

Referring once again to FIG. 1, it will be seen that a needle thread clamping device, generally identified by the numeral 243 is mounted on the arm 140. The clamping device 243 is very similar to that shown in the above-identified Schoij U.S. Pat. No. 3,683,832 and includes a rotary cam 244 secured to a shaft 245 and driven in a counterclockwise direction from the main shaft 144 by conventional gears (not shown). The cam 244 passes between thread eyelets 246 in a forked end 247 of an arm 248 which is secured to a pivot shaft 250 by clamping screw 251. The pivot shaft 250 passes through the arm 140 and extends beyond the rear side of the arm 240 and has a collar 252 (FIG. 3) clamped on its end by means of clamping screws 253.

The collar 252 is provided with a horizontally extending rod 254 which is biased in a clockwise direction by a spring 255.

A pin 256 is slidably mounted in a block 257 and at its upper end is in contact with the rod 254. The bottom end of the pin 256 rides on a cammed surface of a collar 258 which is secured to the work clamp lifter rock shaft 177. It will be apparent that when the shaft 177 is oscillated near the end of a stitching cycle, the cammed collar 258 will rotate and raise the pin 256 against the rod 254, thus rotating the pivot shaft 250 and releasing the thread which was clamped by the cam 244.

Figure 2:
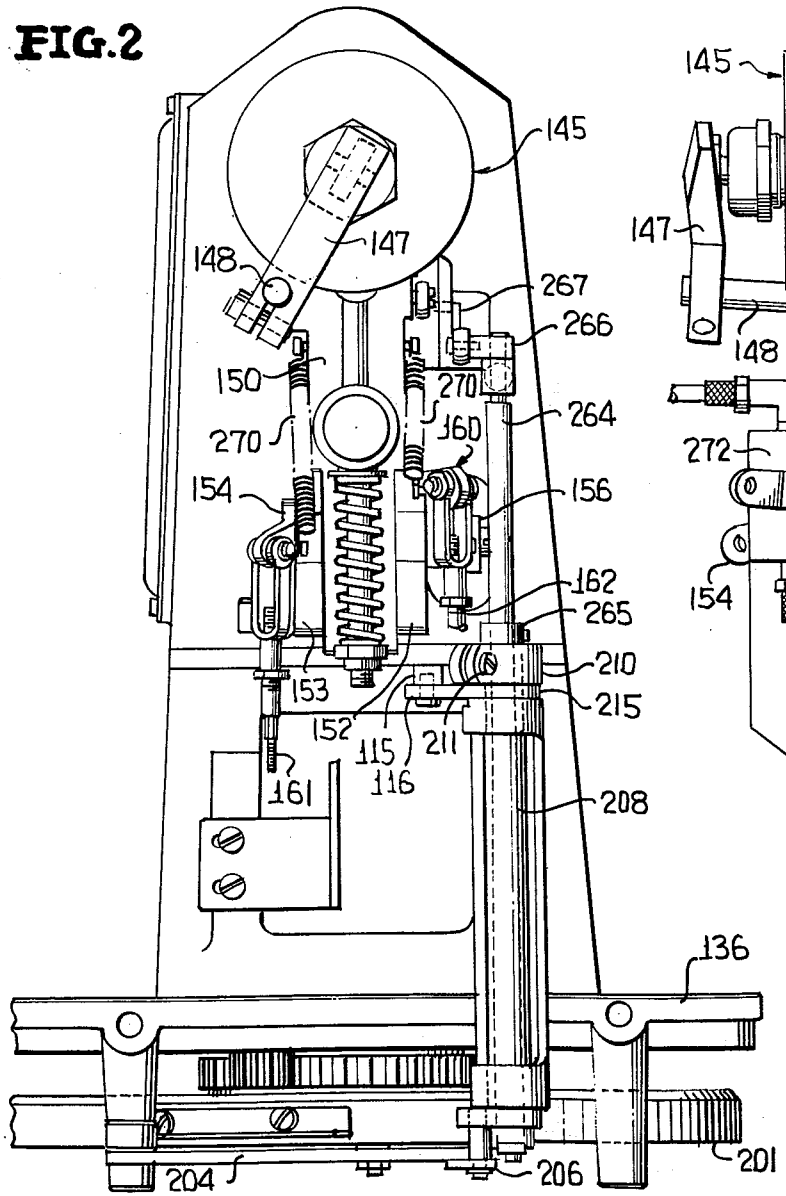
FIG. 2 is an end elevational view of the sewing machine of FIG. 1 as viewed from the right.

Referring now to FIGS. 1, 2 and 7, the sewing machine, as illustrated, is in its running position. In order to stop the machine at the end of a stitching operation, the pawl 168 must be removed from the notches in the latch lever 165. This is accomplished by a cam follower arm 260 disposed in the path of travel of a cam member 261 secured to the bottom of the pattern cam disc 201.

A conventional screw 94 extends down through the screw opening 92 and is threaded into a threaded opening 95 of a bracket 96. The bracket 96 is of a stepped configuration and includes a lower flange 97 having projecting upwardly therefrom a pin 98 which extends into the opening 93. Thus, the screw 94 and the pin 98 cooperate to fixedly clamp the bracket 96 on the underside of the throat plate 90.

The bracket 96 supports for swinging movement a spreader carrying arm 100 which is provided adjacent one end thereof with a bushing 101 receivable over the pin 98, thus mounting the arm 100 for swinging movement.

The arm 100 has formed in the underside thereof remote from the bushing 101 a transversely extending slot 102 in which a straight terminal portion 103 of the loop spreader 83 is positioned. The loop spreader 83 is fixedly secured in the slot 102 by means of a screw 104 which passes through an opening 105 in the loop spreader 83 and is threaded into an internally threaded bore 106 in the arm 100.

The arm 100 is also provided with an intermediate bore 107 which receives an upper portion 108 of a shoulder pin generally identified by the numeral 110. The pin 110 has a lower pin portion 111 on which a roller 112 is journalled, the roller 112 being retained on the pin portion 111 by means of a C clip 113 which is releaseably interlocked in an annular groove 114 formed in the pin 111.

Actuation of the loop spreader 83 is effected by means of a second slide bar 115 which underlies the slide bar 75. Secured on a free end of the slide bar 115 which projects beyond the slide bar 75 is an actuating arm 116. The actuating arm 116 is generally L-shaped in outline and includes an arm portion 117 which extends longitudinally of the slide bar 115. The arm portion 117 has a longitudinal slot 118 therein in which the slide bar 115 is seated. A pair of screws 120 pass upwardly through the arm portion 117 and are threaded into internally threaded bores 121 in the slide bar 115 to secure the actuator arm 116 in place on the slide bar 115.

The actuator arm 116 also includes an arm portion 122 which extends at right angles to the slide bar 75. The arm portion 122 terminates remote from the slide bar 115 in a bifurcated end 123 which defines a slot 124 for the roller 112.

The slide bar 115 is axially reciprocable and is movable first to the right from its normal inoperative position to position the loop spreader 83 and then to the left to return the loop spreader 83 to its normal inoperative position.

The throat plate 90 also carries a needle thread clamping plate 125 which includes an offset flange portion 126 that is seated in a slot 127 formed on the underside of the throat plate 90. The flange portion 126 is secured in the slot 127 by means of a screw 128 which extends through an opening 130 in the flange 126 and is threaded into an internally threaded bore 131 in the throat plate 90.

At this time it is also pointed out that the throat plate 90 is provided with the usual needle hole 132.

Figure 3:
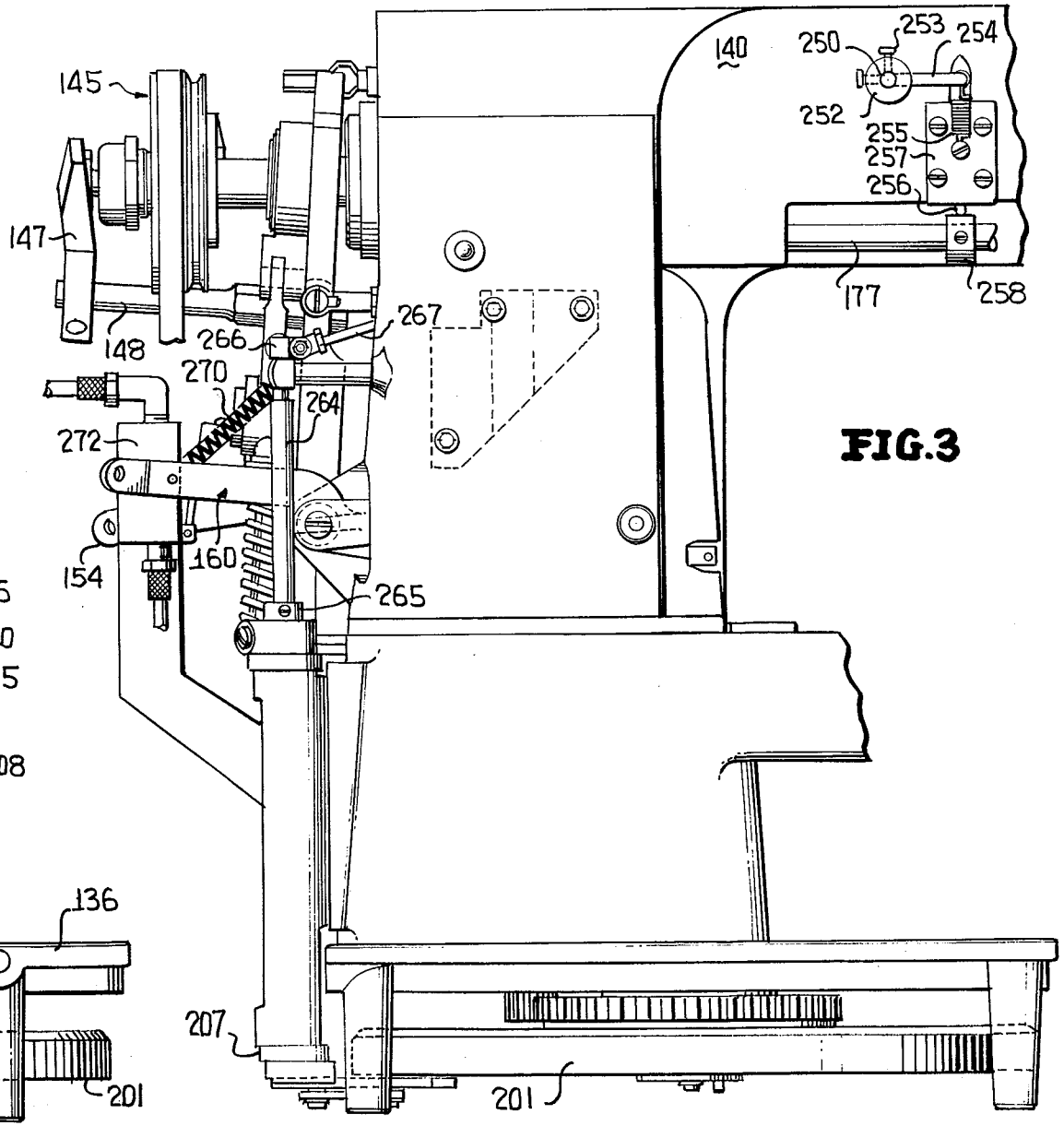
FIG. 3 is a fragmentary rear elevational view of the sewing machine and shows further the details thereof.

It is to be noted that the thread cutter mechanism 20 is particularly adapted to be utilized in conjunction with a sewing machine known in the sewing trade as a lockstitch bar-tacker. This machine is generally illustrated in FIGS. 1–3 of the drawings and is generally identified by the numeral 135. The machine 135 includes a base 136 from which rises a vertical standard 137. From an intermediate point along the vertical standard 137, there is horizontally extending work supporting arm 138. Extending horizontally from the top of the vertical standard 137 and in overlying relation to the work supporting arm 138 is an upper arm 140. At its outer end, the upper arm 140 is provided with a depending head portion 141 which carries a vertically reciprocable needle bar 142 which, in turn, carries a needle 143.

A main drive shaft 144 extends longitudinally of the upper arm 140 and extends outwardly from the right side of the vertical standard 137. The shaft 144 carries a clutch and pulley arrangement, generally identified by the numeral 145 at its right end, as is best shown in FIG. 1. A V-belt 146 connects the clutch and pulley arrangement 145 to a standard two speed driving motor (not shown) of the type disclosed in the prior mentioned Lukins, U.S. Pat. No. 3,565,023. The clutch portion of the clutch and pulley arrangement 145 is engaged and disengaged by a conventional means which includes an arm 147 carried by a rod 148 which extends laterally from a rockable frame 150. The rockable frame 150 is pivotally mounted on a bushing 151 which, in turn, is fixedly mounted in lugs 152, 153 mounted on the right end of the machine as is shown in FIG. 2.

It is to be understood that the stop motion mechanism of the sewing machine, a portion of which includes the rockable frame 150, is of a construction and operation the same as that illustrated and described in the above mentioned Lukins U.S. Pat. No. 3,565,023.

Referring specifically to FIGS. 1 and 4, it will be seen that there is illustrated a starting lever 154 which is attached to a shaft 155 that is journalled in the bushing 151. The shaft 155 extends to the rear of the sewing machine beyond the lugs 152 and at its end there is a second lever 156 which is fixedly secured to the shaft 155 by means of a key-way 157 and a clamping screw 158. The shaft 155 and the levers 154, 156 are thus interconnected so as to act as one piece.

A clamp lifter lever 160 is carried by the shaft 155 between the lugs 152 and the lever 156 for pivotal movemention about the shaft 155. The starting lever 154 is connected by a cable 161 to a first air cylinder (not shown) and the lifting lever 160 is connected by a second cable 162 to a second air cylinder (not shown). At this time it is pointed out that although the sewing machine is particularly adapted for pneumatic operation employing two air cylinders as is shown in the Lukins U.S. Pat. No. 3,565,023,it is possible to utilize a single air cylinder or a mechanical mechanism for operating the sewing machine. The sewing machine could also be operated by a two treadle arrangement. These modifications have not been shown in that the manner in which the levers 154 and 160 are actuated in of itself is not a part of this invention.

The lever 156 extends into the vertical standard 137 and has its end connected by a rod 164 to a latch lever 165 which is pivotally mounted on a block 166 by means of a shoulder screw 167. The latch lever cooperates with a pawl 168 to control the starting and stopping of the sewing machine as described in the above-identified Ketter, et al. U.S. Pat. No. 2,906,222.

One arm 170 of the clamp lifter lever 160 extends from the shaft 155 to the inside of the vertical standard 137. A cam follower pin 171 is secured near the left end of the arm 170 and rides in a cam slot 172 in a The arm 260 is fastened to a rocker arm 262 by a screw 263. The rocker arm 262 is fixedly secured to the lower end of a rock shaft 264 which is arranged coaxially within the tubular rock shaft 208 and is supported therein by a collar 265.

A rocker arm 266 is fastened to the upper end of the rock shaft 264 and is operatively connected to the pawl 168 by a rod 267. As the cam member 261 trips the cam follower arm 260, the rock shaft 264 is rotated slightly and the pawl 168 is pulled from the notches in the latch lever 165 by a rod 267. As is best seen in FIGS. 1 and 2, springs 270 pull the frame 150 into contact with a stop shoulder on a hub 271 and at the same time the arm 147 disengages the clutch and the sewing machine is disconnected from the drive motor. The machine is then stopped. In stopping the machine, the frame 150 contacts an air valve 272 (FIG. 3) which actuates a second air cylinder (not shown) which, in turn, operates the lever 160 which actuates the thread cutter mechanism 20 and raises the work clamp 178.

As described in the Lukins U.S. Pat. No. 3,565,023, the drive motor (not shown) for the sewing machine is switched to its low speed through the actuation of a microswitch 273 (FIG. 7) just prior to the stopping of the sewing machine. The microswitch 273 is provided with an actuating arm 274 having a cam follower 275 which engages the cam disc 201 and is moved by a cam plate 276 fastened on the edge of the pattern cam disc 201 to actuate the microswitch 273.

In the operation of the sewing machine, after inserting a workpiece (not shown) the operator will depress a treadle actuating one of the previously described, but not illustrated air cylinders to pull the cable 161 and pivot the starting lever 154 in a clockwise direction down to the position shown in FIG. 1. The latch lever 165 is rotated to its run position and is locked there by a pawl 168. Rotation of the latch lever 165 causes the arm 147 to engage the clutch and connect the drive motor with the sewing machine through the belt 146. The sewing machine is now driven at high speed and continues to be driven at such speed until the pattern cam disc 201 nears the end of its cycle and the cam plate 276 actuates the microswitch 273 and shifts the motor to its low speed operation.

The pattern cam disc 201 rotates in a counterclockwise direction as seen in FIG. 7. As the cam disc 201 continues to rotate, the roller follower 203 will move to a first step 277 in the cam groove 200. Through the link 206 and rock shaft 208, the collar 210 is rotated about 30 degrees in a counterclockwise direction, as seen in FIG. 13. Near the end of this rotation, the lug 212 contacts the pin 214 and causes a slight movement of the spreader slide bar 115 to the right. The drive screw 192, carried by the bracket 193, rotates the drive lever to slightly lift the clamp lifting lever 170. At this time the loop spreader 83 is also moved slightly towards the needle 143.

At about this time the cam member 261 begins to contact the angled surface 278 at the end of the cam follower arm 260 which begins rotating the rock shaft 264 which, in turn, releases the pawl 168 from the lower notch in the latch lever 165. The latch lever 165 rotates slightly allowing the frame 150 to move to the right partially releasing the clutch means 145 so that the machine will coast during the last revolution before the machine is stopped. Up to this time, the thread cutter mechanism 20 including the loop spreader 83 is in the position shown in FIGS. 16, 16A.

As the roller follower 203 begins to move to step 280 of the cam groove 200 (FIG. 7), the loop spreader 83 begins to move into the needle thread loop 242, as shown in FIGS. 17, 17A. The further movement of the slide bar 115 by the lug 212 and pin 214 also causes further upward movement of the arm 170 by the drive lever 182. This movement of the arm 170 rotates the rock shaft 177 and the cammed collar 258 (FIG. 3) raises the pin 256 rotating the pivot shaft 250 in a clockwise direction, as viewed in FIG. 1, and releasing the thread which has been clamped by the cam 244. With the thread clamp released, the loop spreader 83 can enter the needle thread loop 242, without breaking the thread, as shown in FIGS. 18, 18A. This further upward movement of the arm 170 stops with the cam follower pin 171 just beginning to enter the cam portion of the cam slot 172.

At this time there is about one-half revolution of the main shaft 144 remaining and now the pawl 168 is pulled completely from the latch lever 165 allowing the frame 150 to contact the stop shoulder on the hub 271 and stop the machine with the loop spreader 83 and the thread cutter mechanism 20 in the position shown in FIGS. 18, 18A. The needle thread loop 242 passes around the loop spreader 83 and up through the needle hole 132 and is positioned against the shoulders 86, 87 on the loop spreader 83. The bobbin thread 237 passes from the bobbin up through the needle hole 132 and is positioned against the shoulder 86.

Figure 5:
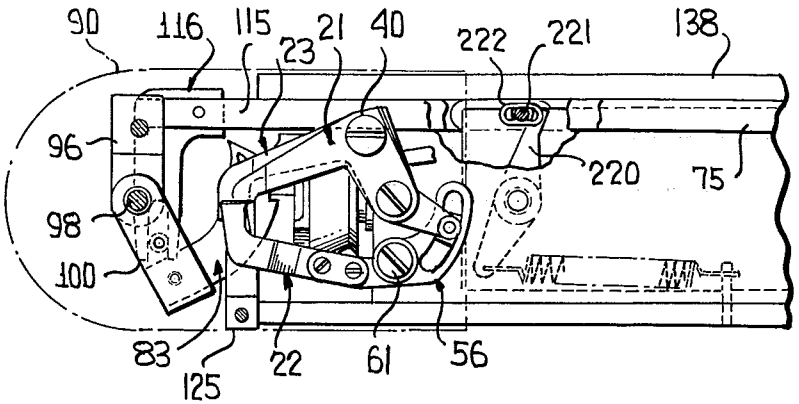
FIG. 5 is another plan view with parts broken away in section and shows the thread cutter mechanism and the operating means therefor in their operative positions.

At the instant the machine is stopped, the frame 150 actuates the air valve 272 which activates the second air cylinder pulling down on cable 162 and thereby pulling down clamp lifter lever arm 160. The other arm 170 of the lifter lever raises and moves the cam follower pin 171 along the cammed area at the central portion of the cam slot 172. The movement of the cam follower pin 171 causes the cutter control lever 173 to pivot in a clockwise direction (FIG. 1), moving the thread cutter slide bar 75 towards the left as seen in FIG. 1. As is best shown in FIGS. 4, 5 and 9, the drive link 80 connected to the slide bar 75 by the bracket 77 will pivot the lower cutter knife 21 and the bobbin pull-off member 23 in a counterclockwise direction about the shoulder screw 27. At the same time, the movement of the pin 72 and slide block 73 in the slot 74 of the upper knife drive lever 56 will pivot the upper cutter knife 22 in a clockwise direction and towards the lower knife 21. As the cutter knives 21, 22 approach each other, the pull-off member 23 will first contact the bobbin thread 237 and pull a certain amount of bobbin thread from the bobbin so that a sufficient amount of bobbin thread will be available to properly start the next stitching cycle.

As the cutter knives 21, 22 come together, the front leg of the needle thread loop 242 and the bobbin thread 237 positioned by the shoulder 86 of the loop spreader 83 are cut by the scissor action of the cutting edges of the cutter knives 21, 22.

As is seen in FIGS. 19, 19A, the threads have been cut with the bobbin thread 237 having been positioned by the pull-off member 23 in the slot 239 in the retainer finger 235. The loose end of the bobbin thread 237 lays over the upturned portion 241 of the plate 240 so it can be easily picked up by the needle thread loop at the beginning of the next stitching cycle.

After the threads have been cut, the arm 170 continues to rise rotating the rock shaft 177 further in order to lift the work clamp 178. The operator can now remove the stitched workpiece and insert a new workpiece. Through the pneumatic controls, the operator now lowers the work clamp 178 and returns the cutter knives 21, 22 and pull-off member 23 to their original positions. The loop spreader 83 is still in the position shown in FIGS. 20, 20A due to the position of the pattern cam disc 201. Therefore, the cam follower pin 171 in the arm 170 of the lifter lever 160 will only return to a position just below the cam portion of the cam slot 172, the arm 170 being stopped by the pin 180 in the drive lever 182. Now the operator can fully depress the control treadle and start the machine to perform a new stitching operation. On its first downward stroke, the needle 143 passes through the slot 88 in the loop spreader 83. The cut thread tail from the needle is too short to form a proper thread loop to pass around the bobbin case and on the upward stroke of the needle, this thread end hangs down through the slot 88 in the loop spreader 83, as seen in FIG. 20.

The rotation of the pattern cam disc 201 now causes the roller follower 203 to pass from step 280 to step 285 and through the previously explained linkages, the loop spreader 83 is moved to the position shown in FIGS. 21, 21A. In moving to this position, the loop spreader 83 has carried the thread end to a clamped position between the loop spreader and the clamping plate 125. The loop spreader 83 is kept in this position by a length of the step 285 for about three strokes of the needle. With the needle thread end clamped, the proper thread loop can be carried around the bobbin case and a proper stitch formed. In forming the first stitch, the needle thread end will be pulled from between the loop spreader 83 and the clamping plate 125. Now the roller follower 203 drops back to the concentric portion of the cam groove 200 and all elements returned to their original positions until the end of the stitching cycle when the thread cutting cycle is again activated.

Although only a single preferred embodiment of the thread cutter mechanism, the sewing machine to which it is attached, and the controls for automatically actuating the same has been illustrated and described herein, it is to be understood that minor variations may be made in the various mechanisms without departing from the spirit and scope of the invention, as defined by the appended claims.

What is claimed as new:

1. A thread cutter mechanism for a sewing machine of the type having means for producing a needle thread loop and for supplying a bobbin thread, said thread cutter mechanism comprising a loop spreader, means mounting said loop spreader for movement into a needle thread loop having two adjacent thread portions for expanding the needle thread loop and transversely separating the thread portions thereof while at the same time positioning the bobbin thread immediately adjacent one needle thread portion, cutter knives, means mounting said cutter knives for cooperating movement, and means for actuating said cutter knives in timed relation to the movement of said loop spreader and in cooperation with one another to sever both the bobbin thread and the one needle thread portion.

2. The thread cutter mechanism of claim 1 together with a bobbin thread pull-off member, and means mounting said bobbin thread pull-off member for movement in timed relation to said cutter knives to first pull off a portion of the bobbin thread in advance of the movement of said cutter knives to sever the bobbin thread, and then after actuation of said cutter knives to sever the bobbin thread positioning a newly formed bobbin thread end portion for pick up in a next sewing operation.

3. The thread cutter mechanism of claim 2 wherein there is a throat plate and said cutter knives, said loop spreader and said bobbin thread pull-off member are all mounted for movement parallel to said throat plate.

4. The thread cutter mechanism of claim 1 wherein there is a throat plate and said cutter knives and said loop spreader are all mounted for movement parallel to said throat plate.

5. The thread cutter mechanism of claim 1 wherein there is a throat plate and said cutter knives are positioned below said throat plate for severing the needle thread portion and the bobbin thread below said throat plate.

6. The thread cutter mechanism of claim 1 wherein there are separate means for actuating said loop spreader and said cutter knives.

7. The thread cutter mechanism of claim 6 wherein said separate means include separate actuator bars, and means for moving said actuator bars in opposite directions.

8. The thread cutter mechanism of claim 1, wherein there is a line of needle movement, said cutter knives are normally located on opposite sides of the line of needle movement, and means mounting said cutter knives include separate pivot points for said cutter knives.

9. The thread cutter mechanism of claim 1 together with a clamp plate cooperable with said loop spreader for holding a newly formed needle thread end portion at the beginning of a new sewing cycle.

10. The thread cutter mechanism of claim 1 wherein there is a line of needle movement, said loop spreader plate having an opening therethrough aligned with the line of needle movement in the operative position of said loop spreader for receiving a newly formed needle thread at the beginning of a new sewing cycle, and a clamp plate cooperable with said loop spreader in an inoperative position thereof for holding the newly formed needle thread.

11. The thread cutter mechanism of claim 1 together with a bobbin thread pull-off member, and means mounting said bobbin thread pull-off member for movement in timed relation to said cutter knives to first pull off a portion of the bobbin thread in advance of the movement of said cutter knives to sever the bobbin thread, and then after actuation of said cutter knives to sever the bobbin thread positioning a newly formed bobbin thread end portion for pick up in a next sewing operation, said cutter knives include upper and lower knives, said bobbin thread pull-off member is positioned below said lower knife, and said means for actuating said cutter knives and said means mounting said bobbin thread pull-off member move said lower knife and said bobbin thread pull-off member in unison.

12. The thread cutter mechanism of claim 1 together with a bobbin thread pull-off member, and means mounting said bobbin thread pull-off member for movement in timed relation to said cutter knives to first pull off a portion of the bobbin thread in advance of the movement of said cutter knives to sever the bobbin thread, and then after actuation of said cutter knives to sever the bobbin thread positioning a newly formed bobbin thread end portion for pick up in a next sewing operation, said means mounting said cutter knives and said bobbin thread pull-off member mount said cutter knives and said bobbin thread pull-off member for arcuate movement and for individual adjustment in the direction of arcuate movement.

13. The thread cutter mechanism of claim 1 together with a bobbin thread pull-off member, and means mounting said bobbin thread pull-off member for movement in timed relation to said cutter knives to first pull off a portion of the bobbin thread in advance of the movement of said cutter knives to sever the bobbin thread, and then after actuation of said cutter knives to sever the bobbin thread positioning a newly formed bobbin thread end portion for pick up in a next sewing operation, said cutter knives include upper and lower knives, and said means mounting said lower knife and said bobbin thread pull-off member include means for vertically adjusting said lower knife and said bobbin thread pull-off member.

14. The thread cutter mechanism of claim 1 wherein said means mounting said loop spreader includes a support and means for mounting said support on a throat plate.

15. The thread cutter mechanism of claim 1 wherein said thread cutter mechanism is part of a sewing machine having a control cam, and said means for actuating said cutter knives being under the control of said control cam.

* * * * *